US006938295B1

(12) United States Patent
Lancaster et al.

(10) Patent No.: US 6,938,295 B1
(45) Date of Patent: Sep. 6, 2005

(54) ORBITAL FLOOR TREATMENT DEVICE

(75) Inventors: J. Clark Lancaster, Birmingham, AL (US); Allan H. Beverly, Villanova, PA (US)

(73) Assignee: Aztec Products, Inc., Telford, PA (US)

( * ) Notice: Subject to any disclaimer, the term of this patent is extended or adjusted under 35 U.S.C. 154(b) by 192 days.

(21) Appl. No.: 10/410,630

(22) Filed: Apr. 9, 2003

Related U.S. Application Data

(60) Provisional application No. 60/371,481, filed on Apr. 9, 2002.

(51) Int. Cl.[7] ..... A47L 11/14; A47L 11/40
(52) U.S. Cl. ..... 15/49.1; 15/98
(58) Field of Search ..... 15/49.1, 50.1, 15/52, 97.1, 98

(56) References Cited

U.S. PATENT DOCUMENTS 1,861,940 A * 6/1932 Roos et al. ..... 451/356
3,416,177 A * 12/1968 Young ..... 15/98
5,355,542 A * 10/1994 Oreck et al. ..... 15/49.1

* cited by examiner

*Primary Examiner*—Randall Chin
(74) *Attorney, Agent, or Firm*—Huntley & Associates, LLC

(57) ABSTRACT

Orbital floor treatment device having a two-component flywheel which facilitates installation and reduces vibration.

8 Claims, 1 Drawing Sheet

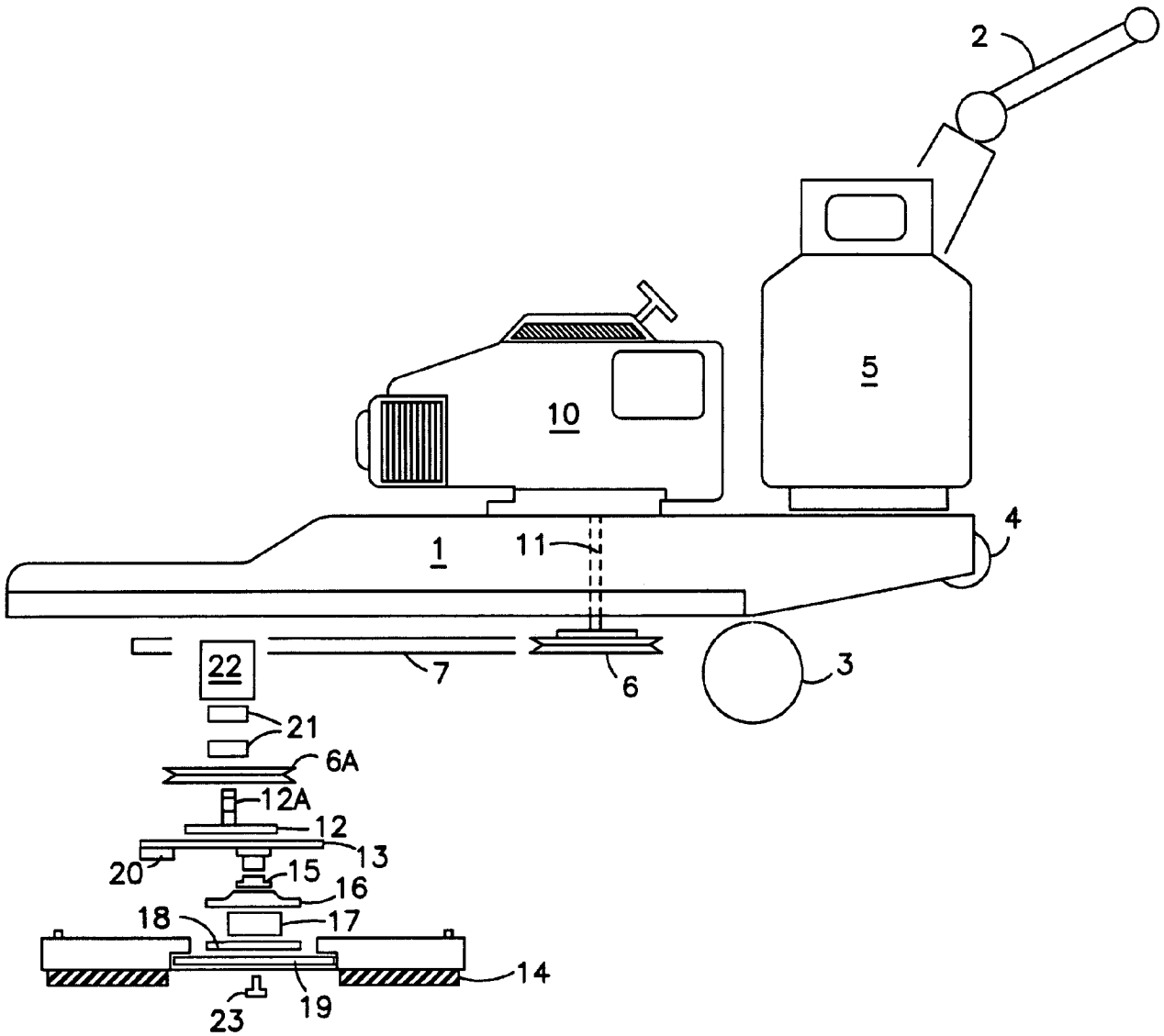
2
5
4
3
10
11
6
1
7
22
21
6A
12A
12
13
15
16
17
14
19
23
18
20

ORBITAL FLOOR TREATMENT DEVICE

CROSS-REFERENCE TO RELATED APPLICATION

This application claims the benefit of U.S. Provisional Application No. 60/371,481, filed Apr. 9, 2002.

BACKGROUND OF THE INVENTION

A wide variety of apparatus has previously been developed for various aspects of floor treatment, including, for example, finishing, buffing and stripping floor surfaces, as well as carpet cleaning. Floor treating machines typically comprise a treatment surface such as a polishing or stripping pad or brush, connected to a rotary drive means. It has long been known that orbital motion for the treatment surface can be especially effective for polishing or stripping. Such orbital motion is typically imparted by using a drive assembly in which force from the rotary drive means is transmitted through a bearing assembly or flywheel that is eccentrically mounted on a drive shaft linking the drive means to the treatment surface. Typical of such devices is that shown in Oreck et al., U.S. Pat. No. 5,355,542, hereby incorporated by reference. A disadvantage of orbital motion in such apparatus is vibration resulting from the eccentric mounting of the assembly. In the past, this been partly alleviated by counterbalancing of the flywheel. However, vibration remains a problem, and continuing effort has been directed to the improvement of such apparatus.

SUMMARY OF THE INVENTION

The present invention is based on the discovery that separating the operative elements of the flywheel linking the drive means and the floor treatment surface facilitates alignment of the components of an orbital apparatus. This, in turn, permits the reduction of vibration.

Specifically, the instant invention provides, in a floor treatment device comprising a power source having a rotating drive shaft, means to transmit power from the rotating drive shaft through a flywheel to at least one floor treatment surface, wherein the flywheel is configured to impart orbital motion to the at least one floor treatment surface, the improvement wherein the flywheel comprises a first component proximal to the power source and a separate second component proximal to the at least one floor treatment surface and parallel to the first component, the first component having means for connecting with the rotating drive shaft, the second component having means for connecting with the at least one floor treatment surface and circumferentially offset from the means on the first component for connecting with the rotating drive shaft, the first and second components being parallel to and fixedly attached to each other.

BRIEF DESCRIPTION OF THE FIGURE

The FIGURE is an exploded, schematic, cross-sectional view of an orbital floor treatment device of the present invention.

DETAILED DESCRIPTION OF THE INVENTION

The FIGURE schematically illustrates one embodiment of the present invention, in which power source 10 is mounted on base 1, the base being equipped with adjustable handle 2, and wheels 3 positioned at a balance point on the base. The base can also have rest wheels 4 positioned at the rear of the base. A wide variety of power sources can be used in the present invention. Self-contained power sources are preferred, such as batteries or propane engines. If batteries are used, typically a system supplying about from 24 to 36 volts is required. Propane engines can be used, such as those available from Honda, Onan and Kawasaki, generating from 13 to 20 horsepower. A propane engine is illustrated here and the power source, shown in conjunction with a fuel tank 5.

The power source is connected by means of a rotating drive shaft 11 to at least one orbitally rotating floor treatment surface 14 through a belt and pulley system, here including engine drive pulley 6 and belt drive 7 to spindle drive pulley 6A. In the embodiment shown, power is transmitted from the rotating drive shaft through a first component 12 proximal to the power source 10 and a separate second component 13 proximal to the at least one floor treatment surface assembly 14. The second component is parallel to the first component, and fixedly attached to the first component by conventional means, not shown, such as bolts. The first component 12 comprises flywheel spindle 12A. This spindle passes through the spindle drive pulley, spindle bearings 21 and bearing house 22 to the base 1. The floor treatment surface and related components are attached to the second flywheel component 13 by bearing clamp bolt 23. It will be understood that the components shown are not drawn to scale, but represent the components that typically make up the assembly. The floor treatment surface and related components are mounted to permit at least the floor treatment surface to protrude below base 1.

As shown in the FIGURE, the assembly also includes a clamp disc 15, which fits over the upper portion of the second component. The assembly further includes bearing housing 16, bearing 17 and spacer 18. The assembly is provided with brush adapter 19. One or more counterweights 20 are generally provided on the edge of second component 13 to balance the system.

The floor treatment surface can vary widely, depending on the intended application for the device. The treatment surface can be adapted, for example, to buffing, scrubbing or stripping of floors, or for cleaning carpets. The first and second components permit the system to be balanced in two separate planes.

The apparatus of the present invention, providing separate components proximal to the power source and floor treatment surface, greatly facilitates manufacture of the apparatus. An integral flywheel, instead of these separate components, is difficult to manufacture and assemble within the precise tolerances required, and deviation from these tolerances can significantly increase vibration during operation and wear. In addition, the first and second flywheel components permit the system to be balanced in two separate planes.

We claim:

1. In a floor treatment device comprising a power source having a rotating drive shaft, means to transmit power from the rotating drive shaft through a flywheel to at least one floor treatment surface, wherein the flywheel is configured to impart orbital motion to the at least one floor treatment surface, the improvement wherein the flywheel comprises a first component proximal to the power source and a separate second component proximal to the at least one floor treatment surface and parallel to the first component, the first component having means for connecting with the rotating drive shaft, the second component having means for connecting with the at least one floor treatment surface and circumferentially offset from the means on the first component for connecting with the rotating drive shaft, the first and second components being parallel to and fixedly attached to each other.

2. A floor treatment device of claim 1 wherein the component proximal to the at least one floor treatment surface comprises a counterweight at an edge thereof.

3. A floor treatment device of claim 1 wherein the power source is self contained.

4. A floor treatment device of claim 3 wherein the power source is at least one battery.

5. A floor treatment device of claim 3 wherein the power source is a propane engine.

6. A floor treatment device of claim 1 wherein the floor treatment surface is a polishing means.

7. A floor treatment device of claim 1 wherein the floor treatment surface is a stripping means.

8. A floor treatment device of claim 1 wherein the floor treatment surface is a scrubbing means.

* * * * *